US006692105B2

(12) United States Patent
Hiroyuki et al.

(10) Patent No.: US 6,692,105 B2
(45) Date of Patent: Feb. 17, 2004

(54) INK JET RECORDING HEAD AND INK JET RECORDING APPARATUS EMPLOYING THE SAME

(75) Inventors: Nomori Hiroyuki, Tokyo (JP); Kawashima Yasuhiko, Saitama (JP); Hirano Tadashi, Tokyo (JP); Ohkubo Kenichi, Tokyo (JP)

(73) Assignee: Konica Corporation, Tokyo (JP)

( * ) Notice: Subject to any disclaimer, the term of this patent is extended or adjusted under 35 U.S.C. 154(b) by 68 days.

(21) Appl. No.: 09/970,639

(22) Filed: Oct. 3, 2001

(65) Prior Publication Data

US 2002/0101477 A1 Aug. 1, 2002

(30) Foreign Application Priority Data

Dec. 1, 2000 (JP) ..... 2000-366535

(51) Int. Cl.[7] ..... B41J 2/135
(52) U.S. Cl. ..... 347/45
(58) Field of Search ..... 347/45; 427/489, 427/490, 515, 503

(56) References Cited

U.S. PATENT DOCUMENTS 5,502,470 A * 3/1996 Miyashita et al. ..... 347/45

FOREIGN PATENT DOCUMENTS

JP 2000119354 * 4/2000

* cited by examiner

*Primary Examiner*—Michael S. Brooke
(74) *Attorney, Agent, or Firm*—Squire, Sanders & Dempsey

(57) ABSTRACT

An ink jet recording head comprises an ink jetting nozzle and a peripheral area of the ink jetting nozzle, the peripheral area having been coated with a coating composition comprising a graft copolymer and a hardener, and having been hardened to provide a hardened coat layer, wherein the graft copolymer is obtained by polymerizing 15 to 70% by weight of a radical polymerizable fluorine-containing resin (a) having a radical polymerizable unsaturated bond through a urethane bond, 10 to 40% by weight of a radical polymerizable polysiloxane (b) having a radical polymerizable double bond on one end thereof represented by formula (1) or (2), and 15 to 75% by weight of a radical polymerizable monomer (c), each being based on the total weight of the radical polymerizable fluorine-containing resin (a), the radical polymerizable polysiloxane (b) and the radical polymerizable monomer (c).

7 Claims, 6 Drawing Sheets

INK JET RECORDING HEAD AND INK JET RECORDING APPARATUS EMPLOYING THE SAME

FIELD OF THE INVENTION

The present invention relates to an ink jet recording head, which is a minute droplet jetting device which jets and shoots a recording liquid, called ink, as minute droplets onto a recording sheet to record an image on the sheet, and an ink jet recording apparatus equipped with such a recording head.

BACKGROUND OF THE INVENTION

FIG. 1 is a developed perspective view showing an example of the construction of a conventional ink jet recording head.

In this recording head, an energy generating element 12 is provided on a substrate 11 made of glass or ceramics, and an ink path 15 in which the energy generating element 12 is provided, an ink jetting nozzle 14, and a common ink reservoir 16 from which ink is supplied to the ink path 15, are formed from a hardened light sensitive resin film 13 according to a photolithography method. The resulting hardened light sensitive resin film 13 is laminated with the upper plate 17 composed of for example, glass, ceramics or metal through an adhesive layer 19.

In the recording head having such construction, the liquid repellent property of the outer surfaces of the substrate 11, the hardened light sensitive resin film 13, and the upper plate 17, each surrounding the ink jetting nozzle 14, is extremely important in stably jetting ink from the ink jetting nozzle 14. If ink flows to the outer surface of the peripheral area of the ink jetting nozzle 14 or adheres thereto to produce a pool of ink there, there may occur an undesirable phenomenon that the ink jetting direction deviates from a given direction in jetting ink from the ink jetting nozzle 14 and further fluctuates every ink jet due to instability of the pool of ink, resulting in inability of stable ink jetting or good image recording.

When the peripheral area of the ink jetting nozzle is covered with ink, ink scatters on ink jetting, and stable recording cannot be carried out. When a pool of ink formed at the peripheral area of the ink jetting nozzle becomes large, ink jetting from the ink jet recording head becomes next to impossible.

The above-described phenomenon can occur in the ink jet recording head having a construction as illustrated in FIG. 2, in which a nozzle plate 21, that is, a thin plate of plastic or metal of an appropriate thickness having orifices (nozzles) 22 of the same number as ink paths 15 of the ink recording head, is additionally adhered to the surface on the side of the ink jetting nozzle 14 of the ink path. In this construction the peripheral area of the ink jetting nozzle is the peripheral area of the nozzles on the outer surface of the additionally provided nozzle plate.

There is also an ink recording head as shown in FIG. 3 in which an upper plate 17 having a common ink reservoir 16, an ink path 15, and an ink jetting nozzle 22 as one body is laminated onto a substrate 11 having an energy generating element 12. The upper plate used in such a construction can be composed of polysulfones, polyethersulfones, polyesters or polyacetals. Further, there is also another ink jet recording head having a construction as shown in FIG. 4, in which an upper plate 46 made of ceramic with a common ink reservoir 47 is adhered to a piezoceramic 41 with an ink path 44 formed by an engraving method, and a nozzle plate 52 is adhered to the ink jetting nozzle side of the ink path 44. The ink jet recording apparatus having such a construction also has a peripheral area of an ink jetting nozzle.

As a method of solving the above problems, there is a proposal which is disclosed in Japanese Patent O.P.I. Publication Nos. 56-89569, 62-55154, 2-153744 and 4-211959 that a coat layer (being a water repellent layer) is provided at least on the outer surface of the peripheral area of the ink jetting nozzle 14 as shown in FIG. 5. In such a technique, silicone type polymers or oligomers, or fluorine-containing polymers or oligomers are used as the water repellent layer.

In the ink jet recording head of the ink jet recording apparatus, the peripheral area of the ink jetting nozzle is always contact with ink, and is usually positioned in a dusty atmosphere, in which dust is produced for example, from the recording paper sheets. Therefore, in order to provide stable ink jetting, the peripheral area of the ink jetting nozzle is required to be wiped with a rubber blade or a sponge for cleaning and thereby kept clean. Further, in order to prevent clogging of the ink jetting nozzle due to dried ink, the ink jet recording head is required to be covered with a cap comprised of a rubber during non-operation. The coverage also prevents ink from evaporating from the ink jetting nozzle. When the ink jetting nozzle of the ink jet recording head is clogged with clogging matter, the clogging matter needs to be removed by applying a means for sucking to the peripheral area of the ink jetting nozzle.

These processes apply stress such as mechanical abrasion, pressure, stretching or peeling to the peripheral area of the ink jetting nozzle of the ink jet recording head. Therefore, the liquid repellent layer provided at the peripheral area of the ink jetting nozzle is required to have sufficient abrasion resistance, sufficient mechanical strength, or sufficient adhesion strength, and to maintain these effects for a long time without being peeled from the peripheral area of the ink jetting nozzle comprised of various materials.

Fluorine-containing polymers or oligomers conventionally used are insufficient in anti-abrasion or mechanical strength on account of substantially low value of its cohesion energy density, and insufficient in adhesion strength on account of substantially low value of its surface energy. Accordingly, they cannot maintain their liquid repellent property for a long time.

Some liquid repellent agents of a silicone type conventionally used provide improved adhesion property, but are insufficient in mechanical strength, particularly in an anti-abrasion property.

In the liquid repellent layer which is insufficient in abrasion resistance, mechanical strength, or adhesion strength, broken pieces, peeled from the peripheral area of the ink jetting nozzle, may be pushed into the ink jetting nozzle by wiping for cleaning, resulting in clogging the whole of the ink jetting nozzle and in inability of ink jetting. Alternatively, the broken pieces clog partially the ink jetting nozzle, resulting in deviation of the prescribed ink jetting direction or in reduction of the prescribed ink jetting amount.

When mechanical peeling occurs at a part of the peripheral area of the ink jetting nozzle, affinity of the peeled portions to liquid ink increases and causes deviation of the ink jetting direction.

These cause deterioration of recording image quality, resulting, at the worst in inability of recording.

It is another important matter for the ink repellent layer used in the ink jet recording head that the ink repellent property of the layer is not lowered even when the layer is in contact with ink for a long time.

When the liquid repellent layer is repeatedly brought into contact with ink, or when the liquid repellent layer is wiped with a rubber blade, for example for cleaning while it is in contact with ink, the liquid repellent property of the layer is lowered in many cases due to interaction between materials constituting the liquid repellent layer and materials constituting ink.

Particularly, silicone type polymers have the tendency described above, and when such silicone type polymers are brought into contact with a certain kind of ink, they may rapidly lose their liquid repellent property.

Fluorine-containing polymers cannot be freed from such a tendency, and there are no fluorine-containing polymers maintaining the initial liquid repellent property after being wiped with a rubber blade during repeated contact with ink.

When the liquid repellent property of the liquid repellent layer is lost, problems occur such that the ink jetting direction deviates from a given direction or ink scatters every ink jetting as when the liquid repellent layer is mechanically broken as described above. When the whole peripheral area of the ink jetting nozzle is covered with ink, ink scatters on ink jetting, resulting in inability of stable recording. The liquid repellent property can be generally represented by a contact angle, particularly a regress contact angle, and more practically, it is represented by the slip property of ink when an ink of a specific composition is used.

SUMMARY OF THE INVENTION

An object of the invention is to provide an ink jet recording head capable of stably jetting ink in a substantially constant amount in the prescribed direction, and an ink jet recording apparatus employing the ink jet recording head.

DETAILED DESCRIPTION OF THE INVENTION

Figure 1:
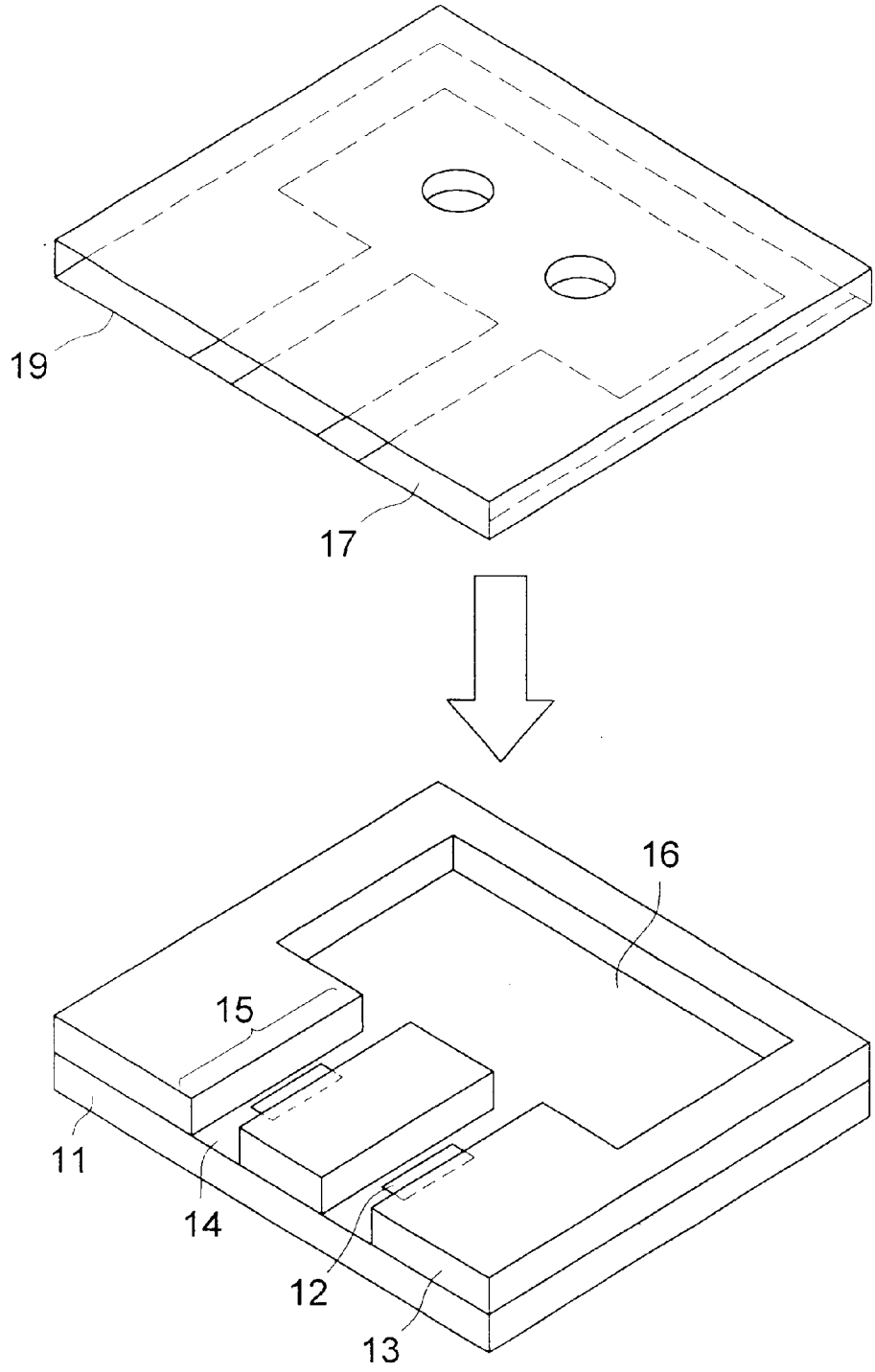
FIG. 1 is a developed perspective view showing an example of the construction of an ink jet recording head to which the present invention can be applied.
Figure 2:
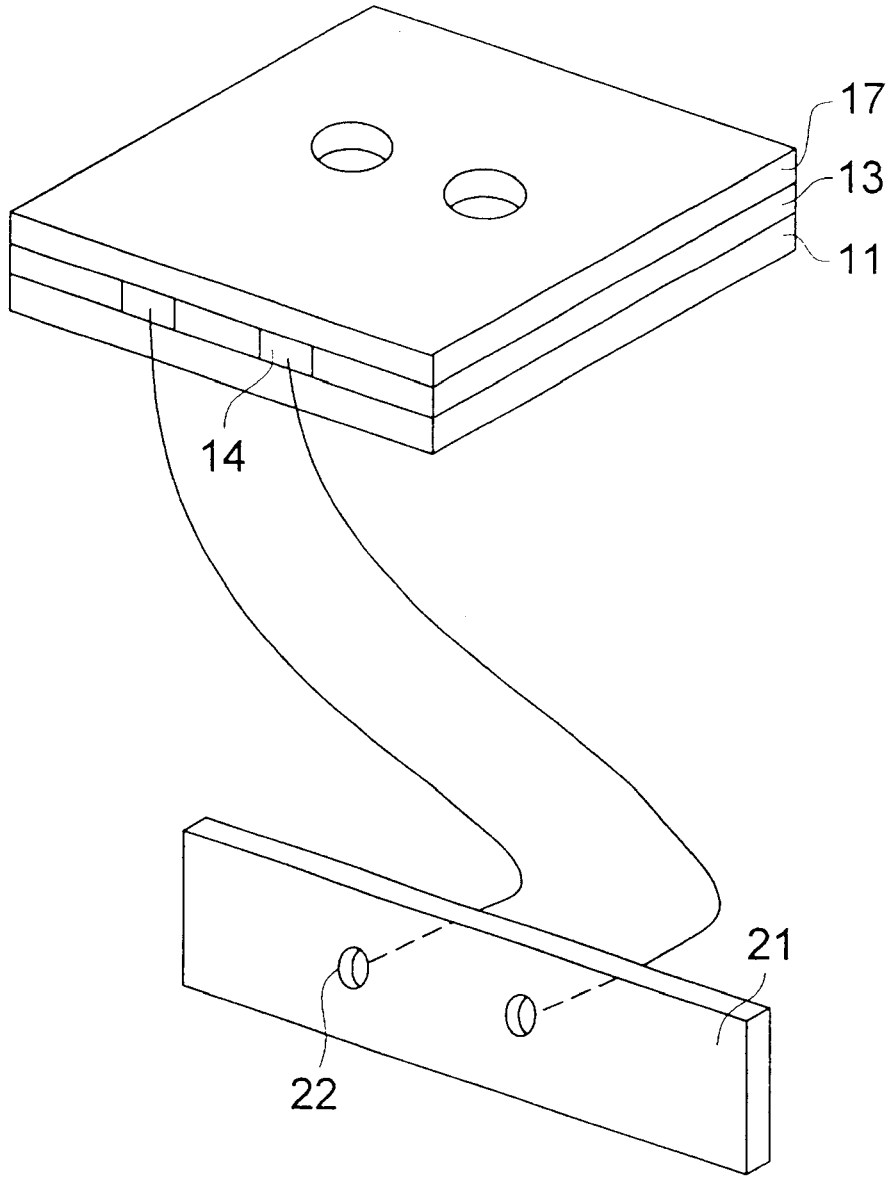
FIG. 2 is a developed perspective view showing an example of the construction of an ink jet recording head to which the present invention can be applied.
Figure 3:
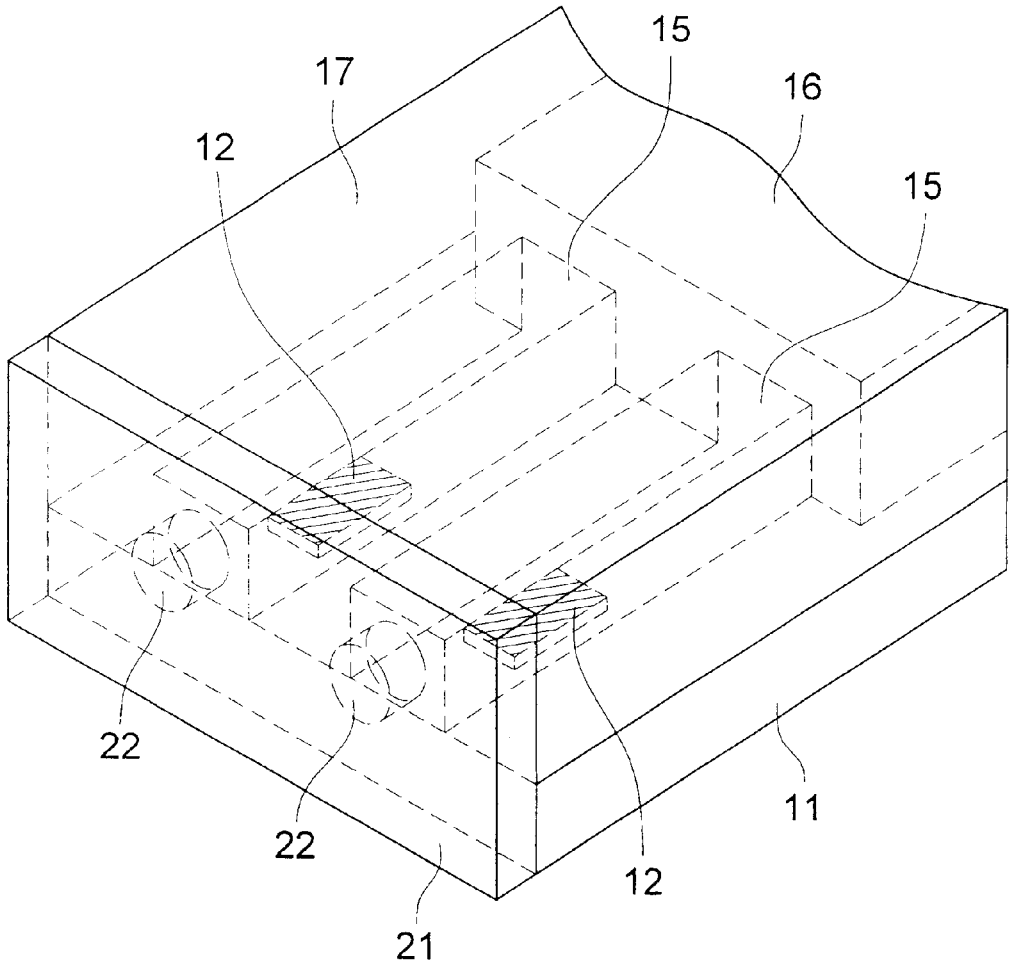
FIG. 3 is a developed perspective view showing an example of the construction of an ink jet recording head to which the present invention can be applied.

The above object of the invention has been attained by the following constitutions:

(1) an ink jet recording head comprising an ink jetting nozzle and a peripheral area of the ink jetting nozzle, the peripheral area having been coated with a coating composition comprising a graft copolymer and a hardener, and then having been hardened to provide a hardened coat layer, wherein the graft copolymer is obtained by polymerizing 15 to 70% by weight of a radical polymerizable fluorine-containing resin (a) having a radical polymerizable unsaturated bond through a urethane bond, 10 to 40% by weight of a radical polymerizable polysiloxane (b) having a radical polymerizable double bond on one end thereof represented by the following formula (1) or (2), and 15 to 75% by weight of a radical polymerizable monomer (c), each being based on the total weight of the radical polymerizable fluorine-containing resin (a), the radical polymerizable polysiloxane (b) and the radical polymerizable monomer (c), formula (1)

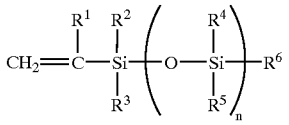

wherein $R^1$ represents a hydrogen atom or a hydrocarbon group having 1 to 10 carbon atoms; $R^2$, $R^3$, $R^4$, $R^5$, and $R^6$ may be the same as or different from another, and independently represent a hydrogen atom or a hydrocarbon group having 1 to 10 carbon atoms; and n is an integer of not less than 2, formula (2)

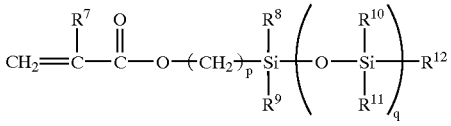

wherein $R^7$ represents a hydrogen atom or a hydrocarbon group having 1 to 10 carbon atoms; $R^8$, $R^9$, $R^{10}$, $R^{11}$, and $R^{12}$ may be the same as or different from another, and independently represent a hydrogen atom or a hydrocarbon group having 1 to 10 carbon atoms; p is an integer of 0 to 10; and q is an integer of not less than 2, (2) the ink jet recording head of item (1) above, wherein the hardener is at least one selected from the group consisting of an aniline-aldehyde resin, a urea resin, a melamine resin, an isocyanate prepolymer, a blocked isocyanate prepolymer, and a diisocyanates, (3) the ink jet recording head of item (1) above, wherein the graft copolymer has a hydroxyl value of 5 to 120.

(4) the ink jet recording head of item (1) above, wherein the graft copolymer has a hydroxyl value of 20 to 80.

(5) the ink jet recording head of item (1) above, wherein the hardened coat layer has a thickness of 0.1 to 5 $\mu$m, (6) an ink jet recording apparatus equipped with an ink jet recording head comprising an ink jetting nozzle and a peripheral area of the ink jetting nozzle, the peripheral area having been coated with a coating composition comprising a graft copolymer and a hardener, and then having been hardened to provide a hardened coat layer, wherein the graft copolymer is obtained by polymerizing 15 to 70% by weight of a radical polymerizable fluorine-containing resin (a) having a radical polymerizable unsaturated bond through a urethane bond, 10 to 40% by weight of a radical polymerizable polysiloxane (b) having a radical polymerizable double bond on one end thereof represented by the following formula (1) or (2), and 1 to 75% by weight of a radical polymerizable monomer (c), each being based on the total weight of the radical polymerizable fluorine-containing resin (a), the radical polymerizable polysiloxane (b) and the radical polymerizable monomer (c), formula (1)

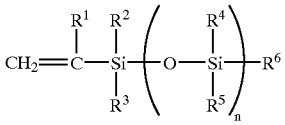

wherein $R^1$ represents a hydrogen atom or a hydrocarbon group having 1 to 10 carbon atoms; $R^2$, $R^3$, $R^4$, $R^5$, and $R^6$ may be the same as or different from another, and independently represent a hydrogen atom or a hydrocarbon group having 1 to 10 carbon atoms; and n is an integer of not less than 2, formula (2)

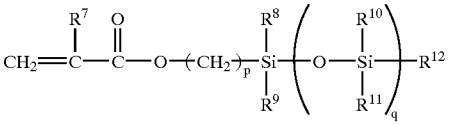

wherein $R^7$ represents a hydrogen atom or a hydrocarbon group having 1 to 10 carbon atoms; $R^8$, $R^9$, $R^{10}$, $R^{11}$, and $R^{12}$ may be the same as or different from another, and independently represent a hydrogen atom or a hydrocarbon group having 1 to 10 carbon atoms; p is an integer of 0 to 10; and q is an integer of not less than 2,

(11) an ink jet recording head comprising an ink jetting nozzle and a peripheral area of the ink jetting nozzle, the peripheral area having a layer coated with coating composition (I) and hardened, wherein the coating composition (I) comprises a graft copolymer and a hardener, the graft copolymer being obtained by polymerizing 15 to 70% by weight of a fluorine-containing resin (a) having a radical polymerizable unsaturated bond through a urethane bond, 10 to 40% by weight of a radical polymerizable polysiloxane (b) having a radical polymerizable group on one end thereof represented by the following formula (1) or (2), and 15 to 75% by weight of a radical polymerizable monomer (c) having a double bond, which is not reacted with said fluorine-containing resin except for radical polymerization through the double bond under radical polymerization conditions used, each being based on the total weight of the fluorine-containing resin (a), the radical polymerizable polysiloxane (b) and the radical polymerizable monomer (c), formula (1)

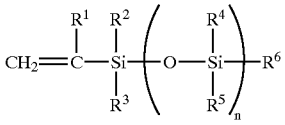

wherein $R^1$ represents a hydrogen atom or a hydrocarbon group having 1 to 10 carbon atoms; $R^2$, $R^3$, $R^4$, $R^5$, and $R^6$ independently represent a hydrogen atom or a hydrocarbon group having 1 to 10 carbon atoms, which may be the same as or different from another; and n is an integer of not less than 2, formula (2)

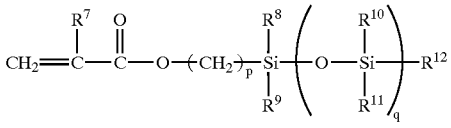

wherein $R^7$ represents a hydrogen atom or a hydrocarbon group having 1 to 10 carbon atoms; $R^8$, $R^9$, $R^{10}$, $R^{11}$, and $R^{12}$ independently represent a hydrogen atom or a hydrocarbon group having 1 to 10 carbon atoms, which may be the same as or different from another; p is an integer of 0 to 10; and q is an integer of not less than 2,

(12) the ink jet recording head of item (11) above, wherein the hardener is at least one selected from the group consisting of an aniline-aldehyde resin, a urea resin, a melamine resin, an isocyanate prepolymer, a blocked isocyanate prepolymer, and diisocyanates,

(13) the ink jet recording head of item (11) or (12) above, wherein the graft copolymer has a hydroxyl value of 5 to 120,

(14) the ink jet recording head of any one of items (11) through (13) above, wherein the graft copolymer has a hydroxyl value of 20 to 80,

(15) the ink jet recording head of any one of items (11) through (14) above, wherein the layer has a thickness of 0.1 to 5 $\mu$m, or

(16) the ink jet recording apparatus equipped with the ink jet recording head of any one of items (11) through (15).

The radical polymerizable fluorine-containing resin (a) having a radical polymerizable unsaturated bond through a urethane bond used in the invention is preferably soluble in an organic solvent. The resin can be prepared, for example by reacting an organic solvent soluble fluorine-containing resin (A-1) having a hydroxyl group with a radical polymerizable monomer (A-2) having an isocyanate group as described in Japanese Patent O.P.I. Publication No. 2000-119354.

The organic solvent soluble fluorine-containing resin (A-1) having a hydroxyl group is not specifically limited, as far as it comprises in the chemical structure at least a unit comprising a hydroxyl group and a polyfluoroalkylene unit. For example, the resin comprises, as a repeating unit, a repeating unit represented by formula (3) and a repeating unit represented by formula (4)

formula (3)

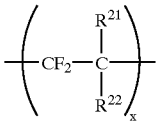

wherein $R^{21}$ and $R^{22}$ may be the same as or different from each other, and independently represent a hydrogen atom, a halogen atom (such as chlorine or fluorine); an alkyl group having 1 to 10 carbon atoms (such as methyl or ethyl); an aryl group having 6 to 8 carbon atoms (such as phenyl); an alkyl group having 1 to 10 carbon atoms having as a substituent one or more of a halogen atom such as chlorine or fluorine (for example, trifluoromethyl, 2,2,2-trifluoroethyl, or trichloromethyl); an aryl group having 6 to 8 carbon atoms having as a substituent one or more of a halogen atom such as chlorine or fluorine (for example, pentafluorophenyl); and X represents an integer of not less than 1, preferably 5 to 100, and more preferably 10 to 50, formula (4)

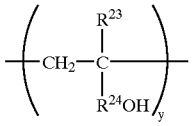

wherein $R^{23}$ represents a hydrogen atom, a halogen atom (such as chlorine or fluorine), an alkyl group having 1 to 10 carbon atoms (such as methyl or ethyl), an aryl group having 6 to 8 carbon atoms (such as phenyl), an alkyl group having 1 to 10 carbon atoms having a substituent one or more of a halogen atom such as chlorine or fluorine, (for example, trifluoromethyl, 2,2,2-trifluoroethyl, or trichloromethyl; or an aryl group having 6 to 8 carbon atoms having a substituent one or more of a halogen atom such as chlorine or fluorine (for example, pentafluorophenyl); $R^{24}$ represents a divalent group selected from the group consisting of OR25a, $CH_2$OR25b, and COOR25c in which R25a, R25b and R25c independently represent a divalent group selected from the group consisting of an alkylene group having 1 to 10 carbon atoms (such as methylene, ethylene, trimethylene, tetramethylene, or hexamethylene), a cycloalkylene group having 6 to 10 carbon atoms (such as cyclohexylene), an alkylidene group having 2 to 10 carbon atoms (such as isopropylidene), an arylene group having 6 to 10 carbon atoms (such as phenylene, tolylene or xylylene); and y represents an integer of not less than 1, preferably 5 to 100, and more preferably 10 to 50.

It is preferred that R25a, R25b and R25c combine with an —OH group of formula (4).

The above organic solvent soluble fluorine-containing resin (A-1) having a hydroxyl group can comprise in the chemical structure a repeating unit represented by formula (5), formula (5)

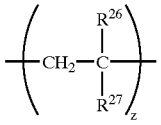

wherein $R^{26}$ represents a hydrogen atom, a halogen atom (such as chlorine or fluorine), an alkyl group having 1 to 10 carbon atoms (such as methyl or ethyl), an aryl group having 6 to 10 carbon atoms (such as phenyl), an alkyl group having 1 to 10 carbon atoms having a substituent one or more of a halogen atom such as chlorine or fluorine (for example, trifluoromethyl, 2,2,2-trifluoroethyl, or trichloromethyl), or an aryl group having 6 to 10 carbon atoms having a substituent one or more of a halogen atom such as chlorine or fluorine (for example, pentafluorophenyl); $R^{27}$ represents OR28a or OCOR28b in which R28a and R28b independently represent a hydrogen atom, a halogen atom (such as chlorine or fluorine), an alkyl group having 1 to 10 carbon atoms (such as methyl or ethyl), an aryl group having 6 to 10 carbon atoms (such as phenyl), a cycloalkyl group having 6 to 10 carbon atoms (such as cyclohexyl), an alkyl group having 1 to 10 carbon atoms having a substituen one or more of a halogen atom such as chlorine or fluorine (for example, trifluoromethyl, 2,2,2-trifluoroethyl, or trichloromethyl), or an aryl group having 6 to 10 carbon atoms having a substituent one or more of a halogen atom such as chlorine or fluorine (for example, pentafluorophenyl); and Z represents an integer of not less than 1, preferably 1 to 100, and more preferably 10 to 50.

The organic solvent soluble fluorine-containing resin comprising the repeating unit represented by formula (5) can increase solubility to organic solvents.

The organic solvent soluble fluorine-containing resin (A-1) having a hydroxyl group has a hydroxyl value of preferably 5 to 130, and more preferably 20 to 90. The fluorine-containing resin (A-1) having the range of the hydroxyl value as described above is preferable in providing a uniform reaction mixture or its compatibility with a radical polymerizable polysiloxane (b) having a radical polymerizable group on one end thereof as described later.

The organic solvent soluble fluorine-containing resin (A-1) having a hydroxyl group can comprise a carboxyl group. The resin having a carboxyl group, when used in combination with melamines, isocyanate prepolymers or blocked isocyanate prepolymers as described later, increases reaction rate and improves hardness, an adhesion property, an ink slip property, and a liquid repellent property of the coat layer.

As the organic solvent soluble fluorine-containing resin (A-1) having a hydroxyl group used in the invention, the resin prepared according to conventional methods or the resin available on the market can be used. The resins available on the market include vinylether type fluorine-containing resins (for example, LUMIFLON LF-100, LF-200, LF-302, LF-400, LF-554, LF-600, and Lf-986, each manufactured by Asahi Glass Co., Ltd.), allylether type fluorine-containing resins (for example, SEFRAL COAT PX-40, A101E, A202B, A402B, 606X, A610XS, A670X, A670XS, A690X, CF-803, each manufactured by Central Glass Co., Ltd.), vinylcarboxylate/acrylic ester type fluorine-containing resins (for example, Zaflon FC-110, FC-220, FC-250, FC-275, FC-310, FC-575, and XFC-973, each manufactured by Toa Gosei Co., Ltd.), and vinylether/vinylcarboxylate type fluorine-containing resins (for example, Fluonate, manufactured by DAINIPPON INK AND CHEMICALS, INCORPORATED). The organic solvent soluble fluorine-containing resins having a hydroxyl group as described above can be used singly or as a mixture of two or more thereof.

The radical polymerizable monomer (A-2) having an isocyanate group is not limited, as long as it is a monomer containing both an isocyanate group and a radical polymerizable unsaturated bond. The monomer (A-2) has preferably a monomer which contains an isocyanate group but does not contain a group other than the isocyanate group (for example, a hydroxyl group or polysiloxane chain). The preferred radical polymerizable monomer (A-2) having an isocyanate group is a radical polymerizable monomer represented by formula (6) or (7)

formula (6)

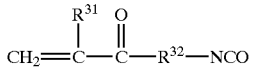

wherein $R^{31}$ represents a hydrogen atom or a hydrocarbon group having 1 to 10 carbon atoms such as an alkyl group having 1 to 10 carbon atoms (for example, methyl, ethyl, propyl, butyl, pentyl or hexyl), an aryl group having 6 to 10 carbon atoms (for example, phenyl), or a cycloalkyl group having 3 to 10 carbon atoms (for example, cyclohexyl); $R^{32}$ represents an oxygen atom or a straight-chained or branched, divalent hydrocarbon group having 1 to 10 carbon atoms such as an alkylene group having 1 to 10 carbon atoms (for example, methylene, ethylene, trimethylene, tetramethylene), an alkylidene group having 2 to 10 carbon atoms (for example, isopropylidene), an arylene group having 6 to 10 carbon atoms (for example, phenylene, tolylene or xylylene), or a cycloalkylene group having 3 to 10 carbon atoms (for example, cyclohexylene);

formula (7)

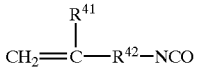

wherein $R^{41}$ represents a hydrogen atom or a hydrocarbon group having 1 to 10 carbon atoms such as an alkyl group having 1 to 10 carbon atoms (for example, methyl, ethyl, propyl, butyl, pentyl or hexyl), an aryl group having 6 to 10 carbon atoms (for example, phenyl), or a cycloalkyl group having 3 to 10 carbon atoms (for example, cyclohexyl); $R^{42}$ represents an oxygen atom or a straight-chained or branched, divalent hydrocarbon group having 1 to 10 carbon atoms such as an alkylene group having 1 to 10 carbon atoms (for example, methylene, ethylene, trimethylene, tetramethylene), an alkylidene group having 2 to 10 carbon atoms (for example, isopropylidene), an arylene group having 6 to 10 carbon atoms (for example, phenylene, tolylene or xylylene), or a cycloalkylene group having 3 to 10 carbon atoms (for example, cyclohexylene).

As the radical-polymerizable monomer (A-2) having an isocyanate group, one or more of methacryloyl isocyanate, 2-isocyanatoethyl methacrylate, and m- or p-isopropenyl-α, α-dimethylbenzylisocyanate is preferably used.

In reaction for preparing the radical polymerizable fluorine-containing resin (a) from the organic solvent soluble fluorine-containing resin (A-1) having a hydroxyl group and the radical polymerizable monomer (A-2) having an isocyanate group, the radical polymerizable monomer (A-2) is used in an amount of preferably 0.001 to less than 0.1 mol, and more preferably 0.01 to less than 0.08 mol per 1 equivalent of the hydroxyl group of the resin (A-1).

When the radical polymerizable monomer (A-2) having an isocyanate group is used in an amount as described above, it is preferable in providing a uniform reaction mixture without causing turbidity or gelation. Reaction of the organic solvent soluble fluorine-containing resin (A-1) having a hydroxyl group with the radical polymerizable monomer (A-2) having an isocyanate group can be carried out at room temperature to 80° C. in the presence or absence of a catalyst.

The radical polymerizable fluorine-containing resin (a) is used in an amount of 15 to 70% by weight based on the total weight of the resin (a), the polysiloxane (b) and the monomer (c) subjected to graft polymerization in the invention. When a graft copolymer obtained by polymerization in an amount less than 15% by weight of the radical polymerizable fluorine-containing resin (a) is used as a coat layer at the peripheral area of the ink jetting nozzle, the liquid repellent property of the coat layer may be deteriorated. On the other hand, when a polymerization was carried out in an amount exceeding 70% by weight of the radical polymerizable fluorine-containing resin (a), gelation, which is unfavorable phenomenon, may occur.

As the radical polymerizable polysiloxane (b) having a radical polymerizable group on one end thereof, a monomer represented by formula (1) can be used. In formula (1) $R^1$ represents a hydrogen atom or a hydrocarbon group having 1 to 10 carbon atoms. Examples of the hydrocarbon group having 1 to 10 carbon atoms include an alkyl group having 1 to 10 carbon atoms (for example, methyl, ethyl, propyl, pentyl or hexyl), an aryl group having 6 to 10 carbon atoms (for example, phenyl), and a cycloalkyl group having 3 to 10 carbon atoms (for example, cyclohexyl). $R^1$ is preferably a hydrogen atom or a methyl group. $R^2$, $R^3$, $R^4$, $R^5$, and $R^6$ in formula (1) may be the same as or different from another. It is preferred that $R^2$, $R^3$, $R^4$, and $R^5$ independently represent a methyl group or a phenyl group. R 6 preferably represents a methyl group, a butyl group or a phenyl group. "n" in formula (1) is an integer of not less than 2, preferably not less than 10, and more preferably not less than 30. "n" in formula (1) is preferably not more than 1500, and more preferably not more than 500.

As the radical polymerizable polysiloxane (b) having a radical polymerizable group on one end thereof, a monomer represented by formula (2) can be used. $R^7$ in formula (2) represents a hydrogen atom or a hydrocarbon group having 1 to 10 carbon atoms, and preferably a hydrogen atom or a methyl group. It is preferred that $R^8$, $R^9$, $R^{10}$, and $R^{11}$ in formula (2) independently represent a hydrogen atom or a methyl group. $R^{12}$ preferably represents a methyl group, a butyl group or a phenyl group. "p" in formula (2) is an integer of 0 to 10, and is preferably 2 to 5. "q" in formula (2) is an integer of not less than 2, preferably not less than 10, and more preferably not less than 30. "q" in formula (1) is preferably not more than 1500, and more preferably not more than 500.

As the radical polymerizable polysiloxane (b) having a radical polymerizable group on one end thereof, a compound prepared according to conventional methods or a compound available on the market can be used. Examples of the compound available on the market include SILAPLANE FM-0711 (number average molecular weight: 1,000, manufactured by Chisso Co., Ltd.), SILAPLANE FM-0721 (number average molecular weight: 5,000, manufactured by Chisso Corporation), SILAPLANE FM-0725 (number average molecular weight: 10,000, manufactured by Chisso Co., Ltd.), X-22-174DX (number average molecular weight: 4,600, manufactured by Shinetsu Kagaku Kogyo Co., Ltd.), X24-8201 (number average molecular weight: 2,100, manufactured by Shinetsu Kagaku Kogyo Co., Ltd.) and X-22-24 (number average molecular weight: 12,000, manufactured by Shinetsu Kagaku Kogyo Co., Ltd.).

In the invention, the radical polymerizable polysiloxanes (b) having a radical polymerizable group on one end thereof represented by formula (1) can be used singly or as a mixture of two or more thereof, the radical polymerizable polysiloxanes (b) having a radical polymerizable group on one end thereof represented by formula (2) can be used singly or as a mixture of two or more thereof, or one or more of the polysiloxanes having a radical polymerizable group on one end thereof represented by formula (1) and one or more of the polysiloxanes having a radical polymerizable group on one end thereof represented by formula (2) can be used in combination.

The radical polymerizable polysiloxane (b) having a radical polymerizable group on one end thereof is used in an amount of 10 to 40% by weight based on the total weight of the resin (a), the polysiloxane (b) and the monomer (c) subjected to graft polymerization in the invention. When the radical polymerizable polysiloxane (b) having a radical polymerizable group on one end thereof is used in an amount less than 10% by weight, a liquid repellent property, an ink slip property or resistance to their deterioration of a coat layer may be insufficient. When the radical polymerizable polysiloxane (b) having a radical polymerizable group on one end thereof is used in an amount exceeding 40% by weight, there may occur an undesirable phenomenon that non-reacted monomers after polymerization remain, resulting in softening of a coat layer or bleeding out of the non-reacted monomers from the coat layer.

The radical polymerizable monomer (c) (hereinafter referred to also as the non-reactive radical polymerizable monomer) is preferably a radical polymerizable monomer having a double bond, which does not react with the radical polymerizable fluorine-containing resin (a) except that radical polymerization is carried out through the double bond of the radical polymerizable monomer under radical polymerization conditions used. The radical polymerizable monomer (c) ordinarily combines with the radical polymerizable fluorine-containing resin (a) by radical polymerization through the double bond. The non-reactive radical polymerizable monomer may have a functional substituent other than the double bond, but it is preferred that the substituent does not react with the radical polymerizable fluorine-containing resin (a).

Examples of such a functional substituent include a halogen atom (for example, fluorine, chlorine or bromine), an alkyl group having 1 to 20 carbon atoms (for example, methyl, ethyl, propyl, butyl, hexyl, lauryl or stearyl), an aryl group having 6 to 10 carbon atoms (for example, phenyl, tolyl, or xylyl), an aralkyl group having 1 to 10 carbon atoms in the alkyl portion and 6 to 10 carbon atoms in the aryl portion (for example, benzyl), (the alkyl, aryl or aralkyl group is hereinafter referred to also as hydrocarbon group R), the hydrocarbon group R having one or more hydroxyl groups (for example, hydroxymethyl, hydroxyethyl, hydroxypropyl, hydroxybutyl, 2,3-dihydroxypropyl, hydroxyphenyl, or 4-hydroxylmethylphenyl), the hydrocarbon group R having one or more nitrile groups (for example, cyanoethyl), the hydrocarbon group R having one or more ether groups (for example, methoxymethyl or ethoxyethyl), the hydrocarbon group R having one or more ester groups (for example, acetoxymethyl), the hydrocarbon group R having one or more tertiary amino groups (for example, dimethylaminomethyl or diethylaminoethyl), the hydrocarbon group R having one or more epoxy groups (for example, glycidyl, 3,4-epoxycyclohexylmethyl), the hydrocarbon group R having one or more amido groups, the hydrocarbon group R having one or more carboxyl groups (for example, carboxymethyl), the hydrocarbon group R having one or more urethane groups, the hydrocarbon group R having one or more urea groups, and the hydrocarbon group R having one or more alkoxysilyl groups (for example, trimethoxysilylmethyl or dimethoxymethylsilylmethyl).

Examples of compounds having a substituent capable of reacting with the radical polymerizable fluorine-containing resin (a) include acid halides (for example, carboxylic acid chlorides, carboxylic acid bromides, phosphoric acid chlorides, or sulfonic acid chlorides), acid anhydride (for example, maleic anhydride), and isocyanate compounds.

Examples of the radical polymerizable monomer (c) used in the invention include a styrene monomer such as styrene, p-methylstyrene, or p-chloromethylstyrene; a (meth)acrylate monomer such as methyl (meth)acrylate, ethyl (meth) acrylate, n-propyl (meth)acrylate, isopropyl (meth)acrylate, n-butyl (meth)acrylate, i-butyl (meth)acrylate, tert-butyl (meth)acrylate, n-hexyl (meth)acrylate, cyclohexyl (meth) acrylate, 2-ethylhexyl (meth)acrylate, lauryl (meth)acrylate, stearyl (meth)acrylate, isobornyl (meth)acrylate, adamantyl (meth)acrylate, phenyl (meth)acrylate, or benzyl (meth) acrylate; a halogenated (meth)acrylate in which a hydrogen atom of the above (meth)acrylate is substituted with a fluorine atom, a chlorine atom or a bromine atom, such as 1H, 1H-perfluoro-n-octyl (meth)acrylate, 1H, 1H-perfluoro-n-decyl (meth)acrylate, or 1H, 1H, 6H, 6H-perfluoro-1,6-hexanediol di(meth)acrylate; a vinyl ester monomer such as vinyl acetate, vinyl benzoate or a branched aliphatic monocarboxylic acid vinyl ester (Beoba: produced by Shell Chemical Co., Ltd.); an acrylonitrile monomer such as acrylonitrile or methacrylonitrile; a vinyl ether monomer such as ethyl vinyl ether, n-butyl vinyl ether, i-butyl vinyl ether, or cyclohexyl vinyl ether; an acrylamide monomer such as meth(acrylamide), N,N-dimethylmeth(acrylamide) or diacetoneacrylamide; a basic nitrogen-containing vinyl monomer such as vinyl pyridine, N,N-dimethylaminoethyl (meth)acrylate, N,N-diethylaminoethyl (meth)acrylate, N,N-dimethyl(meth)acrylamide, 4-(N,N-dimethylamino) styrene or N-[2-(meth)acryloyloxyethyl]-piperidine; an epoxy group-containing vinyl monomer such as glycidyl (meth)acrylate, 3,4-epoxycyclohexylmethyl (meth)acrylate or 3,4-epoxyvinylcyclohexane; an acidic vinyl monomer such as (meth)acrylic acid, angelic acid, crotonic acid, maleic acid, 4-vinylbenzoic acid, p-vinylbenzene sulfonic acid, 2-(meth)acroyloxyethane sulfonic acid or mono[2-(meth)acryloyloxyethyl]acid phosphate; a hydroxyl group-containing vinyl monomer such as p-hydroxymethylstyrene, 2-hydroxyethyl (meth)acrylate, 2-hydroxypropyl (meth) acrylate, 3-hydroxypropyl (meth)acrylate, 2-hydroxybutyl (meth)acrylate, 4-hydroxybutyl (meth)acrylate, di-2-hydroxyethyl fumarate, polyethylene glycol mono(meth) acrylate, polypropylene glycol mono(meth)acrylate, or an $\epsilon$-caprolactone adduct thereof, an $\alpha,\beta$-unsaturated carboxylic acid hydroxyalkyl ester, an adduct of $\epsilon$-caprolactone with an $\alpha,\beta$-unsaturated carboxylic acid such as (meth)acrylic acid, crotonic acid, maleic acid, fumaric acid, itaconic acid or citraconic acid, or an adduct of the $\alpha,\beta$-unsaturated carboxylic acid with an epoxy compound such as butyl glycidyl ether, phenyl glycidyl ether, or a branched aliphatic monocarboxylic acid glycidyl ester (Cardura E, produced by Shell Chemical Co., Ltd.); a silane compound such as vinyl trimethoxysilane, $\beta$-methacryloxyethyl trimethoxysilane, $\beta$-methacryloxyethyl methyl dimethoxysilane; an olefin monomer such as ethylene or propylene; a halogenated olefin monomer such as vinyl chloride, vinylidene chloride, vinyl bromide, vinyl fluoride, tetrafluoroethylene, or chlorotrifluoroethylene; maleimide; and vinyl sulfonic acid.

As the radical polymerizable monomer (c) to be subjected to graft polymerization, the above monomers may be used singly or as a mixture of two or more thereof, and (meth) acrylate monomers are preferably used in view of copolymerization properties.

The radical polymerizable monomer (C) is used in an amount of 15 to 75% by weight based on the total weight of the resin (a), the polysiloxane (b) and the monomer (c) subjected to graft polymerization in the invention. The amount less than 15% by weight of the monomer (c) makes it difficult to adjust a glass transition point of the graft copolymer, and the amount exceeding 75% by weight of the monomer (c) provides the graft copolymer with poor resistance to deterioration of a liquid repellent property or an ink slip property.

The ratio by weight of the radical polymerizable fluorine-containing resin (a) to the sum of the radical polymerizable polysiloxane (b) and the radical polymerizable monomer (c), that is, the ratio (a)/{(b)+(c)} (hereinafter referred to also as fluorine-containing resin/acryl ratio), is preferably from 2/1 to 1/4. The above range of the fluorine-containing resin/acryl ratio is preferable in improving glossiness or weather resistance of coated layer.

As a method of preparing the graft copolymer in the invention employing the radical polymerizable fluorine-containing resin (a), the radical polymerizable polysiloxane (b) and the radical polymerizable monomer (c) as described above, any conventional polymerization can be used. Use of a solution radical polymerization method or a non-aqueous dispersion radical polymerization method is simple and preferable.

Examples of a solvent used in the polymerization methods include toluene; xylene; a mixture (Solvesso: produced by Esso Petroleum Co., Ltd.) of aromatic hydrocarbon compounds; an aliphatic or acyclic hydrocarbon compound such as n-hexane, cyclohexane, octane, mineral spirit, or kerosene; an ester compound such as ethyl acetate, n-butyl acetate, i-butyl acetate or butylcellosolve acetate; and an alcohol compound such as methanol, ethanol, n-propanol, i-propanol, n-butanol, i-butanol, ethylene glycol, propylene glycol, ethylcellosolve or butylcellosolve. These solvent can be used singly or as a mixture of one or more kinds thereof.

The above-described polymerization can be carried out at from an ordinary temperature to 120° C. in the presence of a radical polymerization initiator such as azo compounds or peroxide compounds. In the polymerization, various chain transfer agents such as butyl mercaptan, dodecyl mercaptan, or $\alpha$-methylstyrene dimmer can be used for the purpose of adjusting a molecular weight.

The molecular weight of the graft copolymer in the invention is not specifically limited, but its weight average molecular weight is preferably 5,000 to 2,000,000, and more preferably 10,000 to 1,000,000 in terms of polystyrene according to gel permeation chromatography. The above molecular weight range of the graft copolymer is preferable in preventing deterioration of its film making property or liquid repellent property or in preventing gelation in the polymerization reaction.

In the invention, a combination of the graft copolymer and a hardener is used as a hardenable coating composition, and a coating liquid comprising the above combination is used for coating.

The hardener is one capable of hardening a layer formed by the coating composition in the invention. For example, compounds known as hardeners for an acrylic type hardenable coating composition can be used. Examples of the hardeners include aniline aldehyde resin, melamine resin, isocyanate prepolymers, blocked isocyanates and isocyanates.

Isocyanate prepolymers are especially preferable as a hardener. The hydroxyl value of the graft copolymer in the invention is one of elements having an influence on properties of a hardened coat layer. The hydroxyl value of the graft copolymer can be controlled by the hydroxyl value of the radical polymerizable fluorine-containing resin (a) or by the amount used of the radical polymerizable monomer (c) when the monomer (c) has a hydroxyl group in its chemical structure.

The graft copolymer in the invention has a hydroxyl value of preferably from 5 to 120, and more preferably 20 to 80, which can provide a liquid repellent layer having a sufficient abrasion resistance, a sufficient mechanical strength, a sufficient adhesion strength, a high liquid repellent property, and a high durability property.

The hardener is added to the coating composition so that the equivalent amount ratio of the hydroxyl group of the graft copolymer to the reactive group (for example, an —NCO group) of the hardener is preferably 1:0.6 to 1:1.5, and more preferably 1:0.7 to 1:1.3, that is, the ratio, (the number of hydroxyl groups in 1 mole of the graft copolymer x the weight amount added of the graft copolymer/the average molecular weight of the graft copolymer):(the number of reactive groups in 1 mole of the hardener x the weight amount used of the hardener/the molecular weight of the hardener) is preferably 1:0.6 to 1:1.5, and more preferably 1:0.7 to 1:1.3.

The coating composition in the invention is ordinarily dissolved in an appropriate solvent to prepare a coating liquid, and the resulting coating liquid is coated on the peripheral area of the ink jetting nozzle in the invention, and hardened. A method of preparing the coating liquid is not specifically limited. The polymerization mixture itself obtained by the polymerization as described above may be used for preparing the coating liquid. Further, the graft copolymer, after isolated from the polymerization mixture, may be again dissolved in an appropriate solvent to prepare the coating liquid. Examples of the solvent used to prepare the coating liquid include an aromatic hydrocarbon solvent such as toluene, xylene, etc., an aliphatic hydrocarbon solvent such as n-hexane, cyclohexane, octane, mineral spirit, kerosene, etc., an ester solvent such as ethyl acetate, n-butyl acetate, butyl cellosolve acetate, etc., and a ketone solvent such as acetone, methyl ethyl ketone, methyl isobutyl ketone, cyclohexanone, etc. These solvents may be used singly or as a mixture of one or more thereof. The hardener may be directly added to the coating liquid or may be added to the coating liquid in a form of a solution containing the hardener. The solid content of the coating liquid in the invention is not specifically limited, but suitably determined depending on its usage or coating methods. The solid content of the coating liquid is preferably 10 to 40% by weight. The coating liquid in the invention optionally contains fluorine-containing resin powder, silicone resin powder, various silica particles, or titanium oxide particles. As the coating method there are mentioned a wire bar coating method, a roll coating method, a gravure coating method, a screen printing coating method, a spray coating method, and a dip-coating method. Hardening conditions are not specifically limited, but hardening is ordinarily carried out at from room temperature to 200° C. for 1 minute to 7 days.

The peripheral area of the ink jetting nozzle in the invention is coated with the coating liquid in the invention to form a coat layer. The thickness of the coat layer is preferably 0.05 to 10 $\mu$m, and more preferably 0.1 to 5 $\mu$m.

The ink recording head of the invention has an ink jetting nozzle, and is not limited to those having the construction as described above. As the construction of the ink recording head of the invention, there is one having various similar ink jetting nozzles or one having a plate having a number of ink jetting nozzles, so-called nozzle plate. The peripheral area of the ink jetting nozzle in the invention means the peripheral area of the ink jetting nozzle on the outer surface of the ink recording head which ink can reach.

The constructions of the ink recording head of the invention include those as described in U.S. Pat. Nos. 4,558,333 and 4,459,600, which have a heating section positioned at the deforming area, in addition to a combined construction (a straight liquid path or right angled liquid path) of an ink jetting nozzle, an ink path, and an electrothermal transducer. The constructions of the ink recording head of the invention include those as described in Japanese Patent O.P.I. Publication No. 59-123579, which further comprises a slit common to the plural electrothermal transducers as an outlet of the electrothermal transducers, and those as described in Japanese Patent O.P.I. Publication No. 59-138461, in which openings absorbing a pressure wave of heat energy face ink jetting nozzles.

The recording head of a full line type, which is capable of recording a length corresponding to a maximum width of the recordable largest size recording medium, may be a recording head having a construction capable of recording the length by a combination of plural recording heads, or one recording head constructed as one body. The recoding head of the invention may be a recoding head of any type, and can provide the excellent results as described above.

The present invention is useful for a compatible recording head of a chip type, which is mounted on the recording apparatus and ink can be electrically supplied to the head from the recording apparatus, or for a recording head of a cartridge type, which is integrally provided in the recording apparatus.

The ink jetting recording apparatus of the invention is equipped with the above-described ink recording head and another means necessary to record an image on a recording medium.

It may be preferable to additionally provide a recovering means for a recording head and an auxiliary means as a spare means onto the structure of the recording apparatus of the present invention, because the effect of the present invention can be performed more efficiently. More concretely, as the recovering means for the recording head, there may be a capping means, a cleaning means and a pressing or sucking means and as the auxiliary means, a electrothermal transducer, another heating element or the combination of the electrothermal transducer and the another heating element. Further, it may be effective to conduct a preliminary jetting mode separately from the recording mode, because the recording can be conducted more stably.

Figure 6:
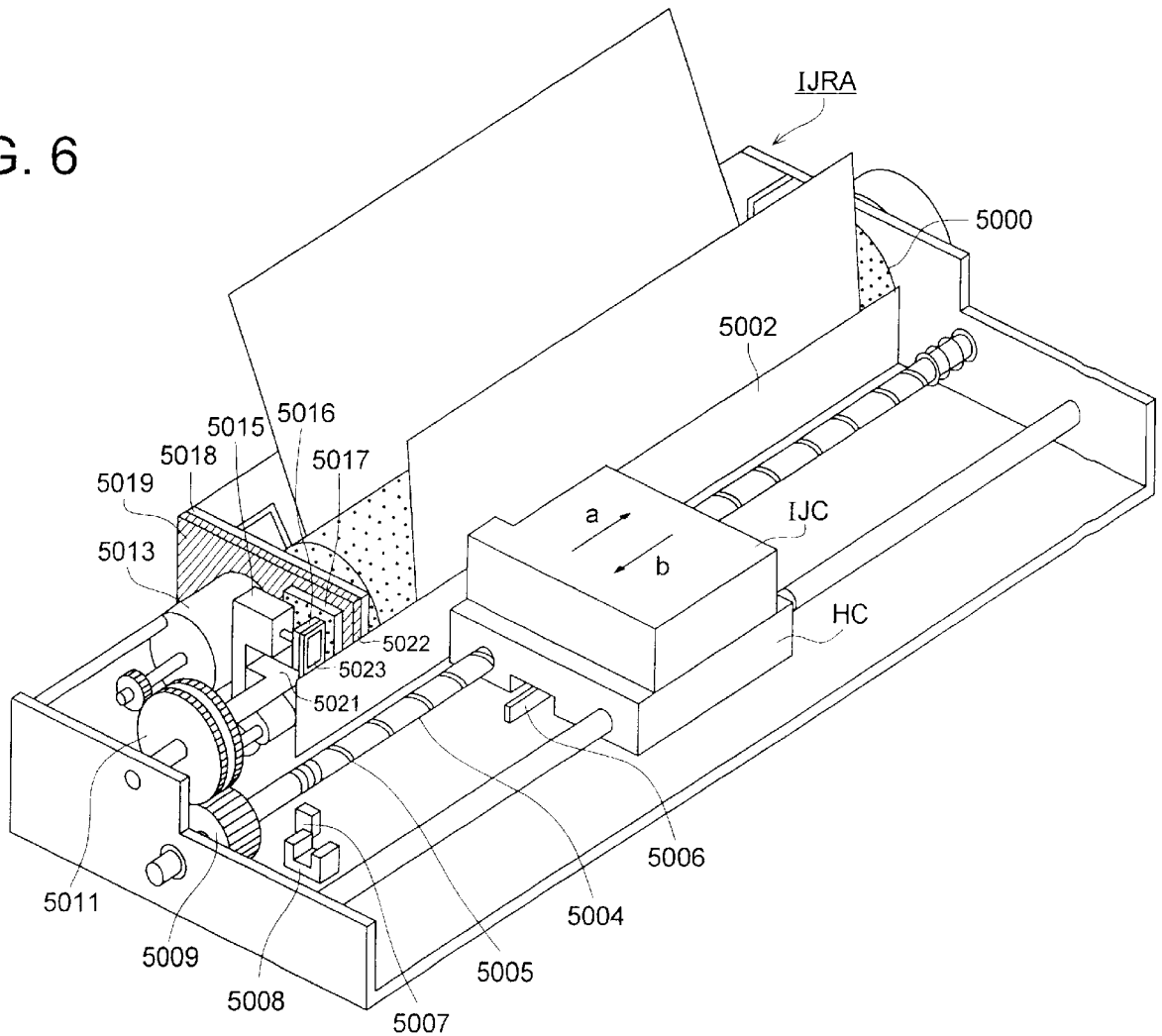
FIG. 6 is a perspective view showing main parts of a recording apparatus in which a recording head of the present invention is mounted.

FIG. 6 is an outlined view of an example of the recording apparatus to which the present invention can be applied. The notation IJC represents an inkjet cartridge mounted on the inkjet recording head, IJRA is an apparatus body and HC is a carriage. The carriage HC has a pin engaged with a line groove 5004 of a lead screw 5005, whereby the carriage is shifted forwardly or backwardly in a direction of an arrowed mark "a" or "b" by the line groove 5004 which is rotated through a driving force transmitting gear train 5011 and 5009 in synchronization with a regular rotation or a reverse rotation of a driving motor. The reference numeral 5002 is a paper pressing plate to press a paper onto a platen 5000 along the shifting direction of the carriage. The reference numerals 5007 and 5008 are a photo-coupler as a home position detecting means by which the presence of a lever 5006 of the carriage at the predetermined position is confirmed in order to switch the rotation direction of the motor 5013. The reference numeral 5016 is a member to support the capping member 5022 to cap the front side of the recording head. The reference numeral 5015 is a sucking means to suck the inside of the cap, thereby conducting a sucking recovering operation for the recording head through a cap-inside hole 5023. The reference numeral 5017 is a cleaning blade and 5019 is a member to make the blade to be able to shift in a forward or backward direction. The cleaning blade 5017 and the member 5019 are supported on a main body supporting plate 5018. In place of the blade in the present embodiment, another well-known cleaning blade can be used in this recording head of the present invention. Further, the reference numeral 5021 is a lever to start the sucking in the sucking recovering operation and the lever 5021 shifts with the movement of the cam 5020 engaged with the carriage. The driving force of the driving motor is controlled and transmitted by a well-known transmitting means such as a clutch.

EXAMPLES

The invention will be detailed according to the following examples, but is not limited thereto. In the examples, the terms "parts" and "%" represent parts by weight and % by weight, respectively, unless otherwise specified.

Commercially available materials employed in the manufacturing examples as described later are shown below.

(1) Fluorine-containing resin (A-1) having a hydroxyl group
- SEFRAL COAT A690X (a hydroxyl value: 58, number average molecular weight: 15,000, solid content: 55.3%, manufactured by Central Glass Co., Ltd.)
- LUMIFLON LF-600 (a hydroxyl value: 54, number average molecular weight: 15,000, solid content: 50%, manufactured by Asahi Glass Co., Ltd.),
- Zaflon FC-275 (a hydroxyl value: 57, number average molecular weight: 10,000, solid content: 60%, manufactured by Toa Gosei Co., Ltd.), (2) Radical polymerizable polysiloxane (b) having a radical polymerizable group on one end thereof
- SILAPLANE FM-0721 (number average molecular weight: 5,000, manufactured by Chisso Corporation)
- X-22-174DX (number average molecular weight: 4,600, manufactured by Shinetsu Kagaku Kogyo Co., Ltd.)

(3) Radical polymerization initiator
- Perbutyl 0 (t-butylperoxy-2-ethylhexanoate, manufactured by Nippon Yushi Co., Ltd.)

(4) Hardener
- Sumidul N3200 (biuret type prepolymer of hexamethylene diisocyanate, manufactured by Sumitomo Bayer Urethane Co., Ltd.)

In examples employing the graft copolymer in the invention for a liquid repellent layer in the ink jet recording head, evaluation of a liquid repellent property, an ink slip property, deterioration resistance thereof or deterioration of performance of the ink jet recording head caused by deterioration thereof was carried out as follows.

(1) Liquid Repellent Property Test and Ink Used for Continuous Ink Jetting a) Dye ink (CH21Y): Yellow dye, C.I. ACID YELLOW 79 was dissolved in a mixture solvent of 27.2% of propylene glycol, 18.8% of ethylene glycol and 54.0% of water to give a 5 weight % C.I. ACID YELLOW 79 solution, and was adjusted to a surface tension of 41.2 dyne/cm with Surfinol (manufactured by Nippon Airproducts Co., Ltd.) to obtain dye ink CH21Y. The test results employing this ink are shown in Table 2.

b) Pigment ink (JT529-2): Magenta pigment, C.I. PIGMENT RED 122 was dispersed employing a dispersant JOHNCRYL 61 (produced by Johnson Co., Ltd.) in a mixture solvent of 25.0% of ethylene glycol, 16.0% of glycerin, 5% of triethyleneglycol monobutyl ether and 54.0% of water to give a 5 weight % C.I. PIGMENT RED 122 dispersion, and was adjusted to a surface tension of 34 dyne/cm with Surfinol to obtain pigment ink JT529-2. The test results employing this ink are shown in Table 3.

(2) Advancing Contact Angle and Receding Contact Angle

Contact angle was measured according to an ordinary method, employing a contact angle meter CA-X (produced by Kyowa Kaimen Kagaku Co., Ltd.) and a micro-syringe attached thereto. The contact angle of ink droplets extended on the liquid repellent layer was measured as an advancing contact angle, and the contact angle of ink droplets contracted on the liquid repellent layer as a receding contact angle.

(3) Ink Slip Property Test

Ink of 0.25 ml was dropped on the hardened liquid repellent layer placed on a smooth plane to form an ink droplet. The ink droplet was softly wiped with the side of a glass rod having a diameter of 5 mm and a length of 50 mm by gravity, and evaluated according to the following criteria:

A: Observed scattering or spreading of the ink droplet was very slight.

B: Ink droplet spread a little, but did not scatter as minute droplets nor formed a continuous line of the ink.

C: Ink droplet did not scatter as minute droplets, but formed a continuous line of the ink.

(4) Deterioration Resistance (Durability) Test

A disk plate with a diameter of 60 mm is provided on the axis of a small-sized motor so that the disk plate can rotate within its own plane. A polyurethane rubber blade with a thickness of 2 mm, a width of 10 mm, and a length of 15 mm is fixed on the disk plate so that the width direction of the blade is in accordance with the diameter direction of the disk plate, the length direction of the blade is perpendicular to the disk plate plane, and the center of the blade width of the blade is positioned 20 mm distant from the center of the disk plate. Thus, a wiping device is prepared. On a sample having a liquid repellent coat layer, which was fixed on a smooth, horizontal glass plate, was fixed the wiping device so that the motor axis was perpendicular to the plane of the sample, and pressure was applied to the sample at a blade compression amount of 1 mm. Then, 50 $\mu$l of ink were dropped on the liquid repellent coat layer of the sample to be in contact with the polyurethane blade, and the liquid repellent coat layer was wiped with the blade at a rotational speed of the motor providing a line speed of the blade width center being 150 mm/second. After 10,000 rotations, the advancing contact angle, the receding contact angle, the ink slip property, and deterioration thereof were determined, whereby deterioration resistance thereof was evaluated.

Synthesis of Radical Polymerizable Fluorine-Containing Resin (A-I)

In a reaction glass vessel a mixture of 1554 parts of Sefralcoat A69OX, 170 parts of xylene, and 6.3 parts of 2-isocyanatoethyl methacrylate was reacted at 80° C. for two hours at an atmosphere of a dry nitrogen gas. Disappearance of the isocyanate absorption was confirmed in the infrared absorption spectra of the resulting reaction mixture. Thus, a radical polymerizable fluorine-containing resin (A-I) having a radical polymerizable unsaturated bond through a urethane bond was obtained, which had a hydroxyl value of 55.

Synthesis of Radical Polymerizable Fluorine-Containing Resin (A-II)

Reaction was carried out in the same manner as in synthesis of radical polymerizable fluorine-containing resin (A-I), except that a mixture of 2078 parts of Rumiflon-600, 10 parts of xylene, and 6.3 parts of 2-isocyanatoethyl methacrylate was used instead of the reaction mixture used in synthesis of radical polymerizable fluorine-containing resin (A-I). Thus, a radical polymerizable fluorine-containing resin (A-II) having a radical polymerizable unsaturated bond through a urethane bond was obtained, which had a hydroxyl value of 52.

Synthesis of Radical Polymerizable Fluorine-Containing Resin (A-III)

Reaction was carried out in the same manner as in synthesis of radical polymerizable fluorine-containing resin (A-I), except that a mixture of 1572 parts of Zaflon FC-275, 325 parts of xylene, and 6.3 parts of 2-isocyanatoethyl methacrylate was used instead of the reaction mixture used in synthesis of radical polymerizable fluorine-containing resin (A-I). Thus, a radical polymerizable fluorine-containing resin (A-III) having a radical polymerizable unsaturated bond through a urethane bond was obtained, which had a hydroxyl value of 54.

Synthesis of Graft Copolymer 1

In a reaction glass vessel a mixture of 26.1 parts of radical polymerizable fluorine-containing resin (A-I) obtained above, 19.5 parts of xylene, 16.3 parts of n-butyl acetate, 3.1 parts of methyl methacrylate, 2.3 parts of n-butyl methacrylate, 2.3 parts of lauryl methacrylate, 5.2 parts of FM-0721 and 0.1 parts of Perbutyl 0 was reacted under reflux at 90° C. for two hours at an atmosphere of a nitrogen gas. The resulting reaction mixture was further added with 0.1 parts of Perbutyl 0 and reacted for additional 5 hours to obtain a graft copolymer 1 solution having non-volatile matter of approximately 35%. The weight average molecular weight of the graft copolymer 1 was 171,000.

Synthesis of Graft Copolymers 2 to 10 and Comparative Graft Copolymers 1 to 5

Solutions of graft copolymers 2 to 10 and comparative graft copolymers 1 to 5 were prepared in the same manner as in the graft copolymer 1 solution, except that materials, solvents and polymerization initiators used were changed as shown in Table 1. The amount copolymerized of radical polymerizable polysiloxane (b) having a radical-polymerizable group on one end thereof in comparative graft copolymer 1 was 3.1% by weight and that in comparative graft copolymer 2 was 4.8% by weight, each being lower than the lower limit of the claimed range. The amount copolymerized of radical polymerizable polysiloxane (b) having a radical-polymerizable group on one end thereof in comparative graft copolymer 3 was 49.6% by weight which was higher than the upper limit of the claimed range. the claimed range. The amount copolymerized of radical polymerizable fluorine-containing resin in comparative graft copolymer 4 was 14.1% by weight, which was lower than the lower limit of the claimed range, and that in comparative graft copolymer 5 was 73.4% by weight, which was higher than the upper limit of the claimed range.

In synthesis of comparative graft copolymer 5, the reaction mixture became more viscous as the reaction proceeds, and it was difficult to form a coat film layer from the resulting mixture.

Preparation of Liquid Repellent Coat Layer for Liquid Repellent Property Test Upilex S75 with a thickness of 75 $\mu$m (produced by Ube Kosan Co., Ltd.) was provided on the inside surface of one of a pair of disk electrodes with a diameter of 300 mm arranged at an interval of 40 mm under an oxygen pressure of 10 Pa, the other disc electrode being connected with a capacitor. High frequency power of 13.56 MHz and 200 W was applied between the disc electrodes for 2 minutes to obtain a plasma treated Upilex S75.

Five grams of graft copolymer solution 1 obtained above was mixed with 0.16 g of Sumidul N3200 so that the isocyanate group content was equivalent with the hydroxy content of the graft copolymer 1, then added with 10.7 g of acetone to give a solid concentration of 12% and stirred. The resulting solution was coated by means of a wire bar on the surface subjected to plasma treatment of the plasma treated Upilex, dried to give a dry thickness of 0.4 $\mu$m, and allowed to stand at 150° C. for one hour in an air bath to obtain a hardened liquid repellent coat layer. The resulting layer was designated as coat layer 1.

Coat layers 2 to 10 and comparative coat layers 1 to 5 were prepared in the same manner as in coat layer 1, except that graft copolymers, comparative graft copolymers or hardeners were changed as shown in Tables 2 and 3.

Cytop CTX-809A (9% solution, manufactured by Asahi Glass Co., Ltd.) was diluted by a factor of 3 employing exclusive solvent CT-solv. 180, and the resulting solution was coated by means of a wire bar on the surface subjected to plasma treatment of the plasma treated Upilex, and baked at 200° C. for one hour to give a dry thickness of 0.2 μm. Thus, Sitop liquid repellent layer was obtained.

Neflon FEP ND-1 (manufactured by Daikin Kogyo Co., Ltd.) of 5 ml were added with 15 ml of water, and the resulting solution was coated by means of a wire bar on the surface subjected to plasma treatment of the plasma treated Upilex, and baked at 300° C. for four hours to give a dry thickness of 0.25 μm. Thus, FEP liquid repellent layer was obtained.

SR2410 (manufactured by Toray Dow corning Silicone Co., Ltd.) was coated by means of a wire bar on the surface subjected to plasma treatment of the plasma treated Upilex, and baked at 150° C. for one hour to give a dry thickness of 0.4 μm. Thus, SR2410 liquid repellent layer was obtained.

Preparation of a Nozzle Plate and an Ink Jet Recording Head Equipped with the Nozzle Plate, and Ink Jetting Test The Yupilex film having a liquid repellent layer on its surface as obtained above was bored to form an orifice, by irradiating light from the side of the film opposite to the liquid repellent layer at a light flux on the irradiation surface of 1–2 J/cm$^2$, employing a light source, a Kr+F2 (Ne) excimer laser (wavelength of 248 nm) having 400 mJ/pulse and 200 Hz. The orifice had a conical angle of 80°.

Figure 4:
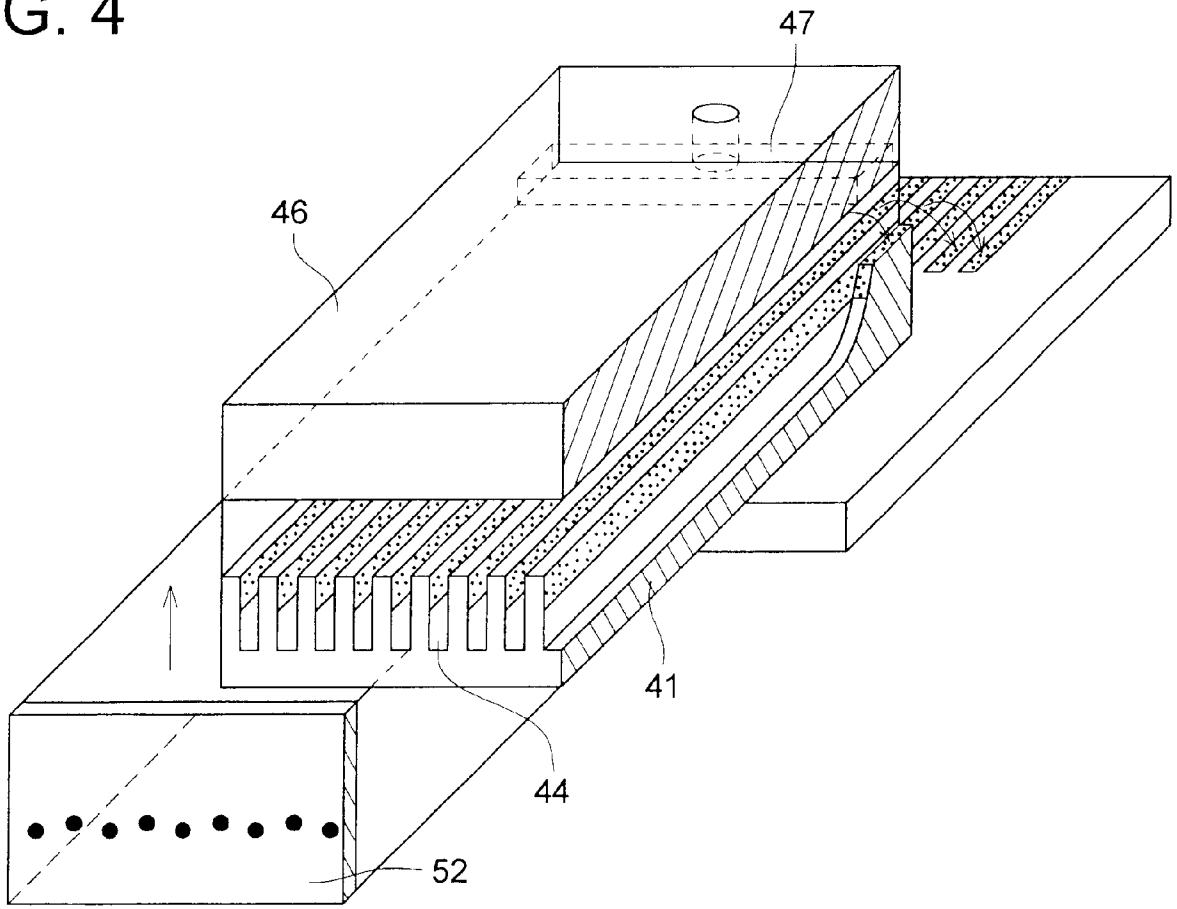
FIG. 4 is a developed perspective view showing an example of the construction of an ink jet recording head to which the present invention can be applied.
Figure 5:
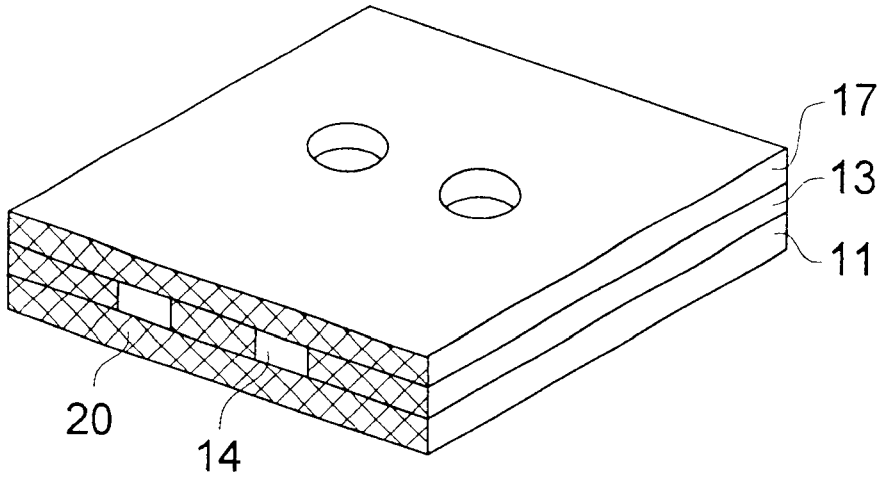
FIG. 5 is a developed perspective view showing an example of the construction of an ink jet recording head to which the present invention can be applied.

The thus obtained nozzle plate was mounted on the ink jet recording head as shown in FIG. 4, and test was carried out in which ink was continuously jetted $10^9$ times at an interval of 25 usec. Evaluation was carried out according to the following criteria:

C: During the test, ink jetting stopped.

B: During the test, ink jetting did not stop, but ink jetting direction deviated from a given direction or scattered.

A: During the test, ink jetting was carried out without any trouble.

Similarly, the nozzle plate subjected to the deterioration resistance test above was also mounted on the ink jet recording head, and subjected to ink jetting test in the same manner as above.

In Tables 2-1 and 2-2 are also shown the test results of an ink jet recording head prepared to have the same construction as above, except that Cytop CTX-809A (manufactured by Asahi Glass Co., Ltd.), FEP (manufactured by Daikin Kogyo Co., Ltd.) or a typical silicone type liquid repellent film, SR2410 (manufactured by Toray Dow corning Silicone Co., Ltd.), each being conventionally used, was used as a liquid repellent layer.

Coat layers 1 through 10 showed excellent results in all the evaluations in both initial property and deterioration resistance. Comparative coat layer 1, comprising in an amount lower than the lower limit of the claimed range a radical polymerizable polysiloxane having a radical-polymerizable group on one end thereof, showed a poor ink slip property even in the initial property. Similarly, Comparative coat layer 2 showed poor initial properties. In Comparative coat layer 3, comprising in an amount higher than the upper limit of the claimed range a radical polymerizable polysiloxane having a radical-polymerizable group on one end thereof, bleed-out of unhardened matter was observed on the surface of the coat layer.

Comparative coat layer 4 comprising comparative graft copolymer 4, in which the content of a radical polymerizable fluorine-containing resin was lower than the lower limit of the claimed range, showed a poor liquid repellent property even in the initial property. Comparative coat layer 5 comprising comparative graft copolymer 5, in which the content of a radical polymerizable fluorine-containing resin was higher than the upper limit of the claimed range, did not form a flat surface layer, and the above evaluations could not be carried out.

In the liquid repellent layers conventionally used, the Cytop liquid repellent layer had an excellent liquid repellent property, but was low in mechanical strength and adhesion strength. Further, the test thereof after the 10,000 rotations provided a poor deterioration resistance.

The FEP liquid repellent layer, when pigment ink was used, resulted in lowered liquid repellent property after the 10,000 rotations.

The SR2410 liquid repellent layer provided a low receding contact angle in the initial property. Further, it caused ink scattering immediately after the beginning of the continuous ink jetting, resulting in inability of ink jetting.

TABLE 1

| | Graft Polymer | | | | | | |
|---|---|---|---|---|---|---|---|
| | Graft copolymer 1 | Graft copolymer 2 | Graft copolymer 3 | Graft copolymer 4 | Graft copolymer 5 | Graft copolymer 6 | Graft copolymer 7 |
| A-I (solid content: 50 wt %) (parts) | 26.1 | 26.1 | 16.8 | 13.0 | 16.8 | 16.8 | 16.8 |
| A-II (solid content: 49.9 wt %) (parts) | | | | | | | |
| A-III (solid content: 49.9 wt %) (parts) | | | | | | | |
| Xylene (parts) | 19.5 | 19.5 | 23.1 | 26.2 | 23.1 | 23.2 | 22.8 |
| Butyl acetate (parts) | 16.3 | 16.3 | 15.7 | 16.3 | 15.7 | 15.8 | 15.6 |
| MMA (parts) | 3.1 | 2.4 | 3.7 | 4.6 | 2.8 | 4.7 | 2.6 |
| BMA (parts) | 2.3 | 1.8 | 2.8 | 3.4 | 2.1 | 3.5 | 2.0 |
| LMA (parts) | 2.3 | 1.8 | 2.8 | 3.4 | 2.1 | 3.5 | 2.0 |
| HEMA (parts) | | 1.2 | 2.0 | 2.7 | 4.6 | 1.6 | 2.3 |
| FM 0721 (parts) | 5.2 | 5.2 | 5.0 | 5.2 | 5.0 | | |

TABLE 1-continued

| Graft Polymer | | | | | | | |
|---|---|---|---|---|---|---|---|
| X-22-174DX (parts) | | | | | | 2.5 | 7.5 |
| Perbutyl O (parts) | 0.1 | 0.1 | 0.1 | 0.2 | 0.1 | 0.2 | 0.1 |
| Perbutyl O further added (parts) | 0.1 | 0.1 | 0.1 | 0.1 | 0.1 | 0.1 | 0.1 |
| Hydroxyl value | 27.4 | 48.1 | 53.2 | 58.3 | 97.0 | 47.0 | 58.1 |
| Polysiloxane (b) (wt. %) | 19.9 | 20.3 | 20.1 | 19.9 | 19.8 | 10.2 | 30.0 |
| Fluorine-containing resin (a) (wt. %) | 49.9 | 50.9 | 33.7 | 24.9 | 33.3 | 34.3 | 33.6 |
| Fluorine-containing resin/acryl ratio | 1.01 | 1.05 | 0.52 | 0.34 | 0.51 | 0.53 | 0.51 |

| | Graft copolymer 8 | Graft copolymer 9 | Graft copolymer 10 | Comparative graft copolymer 1 | Comparative graft copolymer 2 | Comparative graft copolymer 3 | Comparative graft copolymer 4 | Comparative graft copolymer 5 |
|---|---|---|---|---|---|---|---|---|
| A-I (solid content: 50 wt %) (parts) | | | 16.8 | 16.8 | 16.8 | 16.8 | 4.0 | 67.2 |
| A-II (solid content: 49.9 wt %) (parts) | 16.1 | | | | | | | |
| A-III (solid content: 49.9 wt %) (parts) | | 14.9 | | | | | | |
| Xylene (parts) | 22.9 | 26.2 | 23.1 | 23.3 | 23.2 | 23.0 | 14.3 | |
| Butyl acetate (parts) | 15.4 | 11.6 | 15.7 | 15.8 | 15.8 | 15.7 | 9.7 | 20.4 |
| MMA (parts) | 3.6 | 3.5 | 1.9 | 5.5 | 5.2 | 0.7 | 1.9 | 1.9 |
| BMA (parts) | 2.7 | 2.6 | 1.4 | 4.1 | 3.9 | 0.6 | 1.4 | 1.4 |
| LMA (parts) | 2.7 | 2.6 | 1.4 | 4.1 | 3.9 | 0.6 | 1.4 | 1.4 |
| HEMA (parts) | 2.4 | 2.2 | 7.0 | 2.3 | 2.3 | 2.3 | 2.3 | 2.3 |
| FM 0721 (parts) | 4.9 | 4.7 | 5.0 | 0.8 | | 12.6 | 5.0 | 5.0 |
| X-22-174DX (parts) | | | | | 1.2 | | | |
| Perbutyl O (parts) | 0.1 | 0.1 | 0.1 | 0.2 | 0.2 | 0.1 | 0.1 | 0.1 |
| Perbutyl O further added (parts) | 0.1 | 0.1 | 0.1 | 0.1 | 0.1 | 0.1 | 0.1 | 0.1 |
| Hydroxyl value | 59.0 | 58.2 | 137.5 | 57.0 | 57.7 | 57.2 | 77.5 | 61.9 |
| Polysiloxane (b) (wt. %) | 20.0 | 20.2 | 19.8 | 3.1 | 4.8 | 49.6 | 35.2 | 10.9 |
| Fluorine-containing resin (a) (wt. %) | 32.8 | 32.0 | 33.2 | 33.0 | 33.3 | 33.1 | 14.1 | 73.4 |
| Fluorine-containing resin/acryl ratio | 0.49 | 0.48 | 50.00 | 0.50 | 0.51 | 0.50 | 0.17 | 2.80 |

MMA: methyl methacrylate,
BMA: n-butyl methacrylate,
LMA: lauryl methacrylate,
HEMA: 2 -hydroxyethyl methacrylate

TABLE 2

| Coat layer and test result (use of dye ink CH21Y) | | | | | | | | | | |
|---|---|---|---|---|---|---|---|---|---|---|
| (Non-volatile matter wt. %) | Coat layer | | | | | | | | | |
| | 1 | 2 | 3 | 4 | 5 | 6 | 7 | 8 | 9 | 10 |
| Graft copolymer 1 solution (34.9) g | 5.0 | | | | | | | | | |
| Graft copolymer 2 solution (34.4) g | | 5.0 | | | | | | | | |
| Graft copolymer 3 solution (34.5) g | | | 5.0 | | | | | | | |
| Graft copolymer 4 solution (34.8) g | | | | 5.0 | | | | | | |
| Graft copolymer 5 solution (34.8) g | | | | | 5.0 | | | | | |
| Graft copolymer 6 solution (34.1) g | | | | | | 5.0 | | | | |
| Graft copolymer 7 solution (34.8) g | | | | | | | 5.0 | | | |
| Graft copolymer 8 solution (34.6) g | | | | | | | | 5.0 | | |
| Graft copolymer 9 solution (34.9) g | | | | | | | | | 5.0 | |
| Graft copolymer 10 | | | | | | | | | | 5.0 |

TABLE 2-continued

| Coat layer and test result (use of dye ink CH21Y) | | | | | | | | | | |
|---|---|---|---|---|---|---|---|---|---|---|
| solution (34.9) g | | | | | | | | | | |
| Sumidul N3200 (Mw 478.6) g | 0.16 | 0.27 | 0.30 | | 0.55 | 0.26 | | | 0.32 | 0.78 |
| Sumidul N3300 (Mw 504.6) g | | | | 0.35 | | | 0.35 | 0.35 | | |
| Acetone g | 10.7 | 11.3 | 11.6 | 12.0 | 13.5 | 11.1 | 12.1 | 12.0 | 11.5 | 15.3 |
| Initial properties | | | | | | | | | | |
| Advancing contact angle | 86 | 85 | 85 | 83 | 84 | 80 | 82 | 83 | 82 | 82 |
| Receding contact angle | 72 | 71 | 70 | 69 | 58 | 57 | 73 | 69 | 68 | 48 |
| Ink slip property | A | A | A | A | A | A | A | A | A | A |
| After 10,000 rotations | | | | | | | | | | |
| Advancing contact angle | 78 | 78 | 76 | 74 | 72 | 70 | 71 | 73 | 74 | 71 |
| Receding contact angle | 61 | 67 | 67 | 64 | 61 | 56 | 58 | 64 | 63 | 13 |
| Ink slip property | A | A | A | A | A | A | A | A | A | B |
| Continuous jetting property | | | | | | | | | | |
| Initial | A | A | A | A | A | A | A | A | A | A |
| After 10,000 rotations | A | A | A | A | A | A | A | A | A | B |

| (Non-volatile matter wt. %) | Comparative coat layer 1 | 2 | 3 | 4 | 5 | Cytop | FEP | SR 2410 |
|---|---|---|---|---|---|---|---|---|
| Comparative Graft copolymer 1 solution (34.9) g | 5.0 | | | | | | | |
| Comparative Graft copolyrner 2 solution (34.7) g | | 5.0 | | | | | | |
| Comparative Graft copolymer 3 solution (35.0) g | | | 5.0 | | | | | |
| Comparative Graft copolymer 4 solution (35.3) g | | | | 5.0 | | | | |
| Comparative Graft copolymer 5 solution (35.3) g | | | | | 5.0 | | | |
| Sumidul N3200 (MW 478.6) g | 0.32 | | 0.33 | 0.45 | 0.36 | | | |
| Sumidul N3300 (MW 504.6) g | | 0.34 | | | | | | |
| Acetone g | 11.9 | 12.0 | 12.0 | 13.0 | 12.3 | | | |
| Initial properties | | | | | | | | |
| Advancing contact angle | 81 | 82 | 77 | 73 | — | 97 | 95 | 72 |
| Receding contact angle | 34 | 36 | 72 | 62 | — | 87 | 53 | 35 |
| Ink slip property | B | B | A | A | — | A | B | C |
| After 10,000 rotations | | | | | | | | |
| Advancing contact angle | 68 | 67 | 72 | 58 | — | 88 | 87 | 43 |
| Receding contact angle | 0 | 0 | 23 | 14 | — | 73 | 32 | 0 |
| Ink slip property | C | C | B | C | — | B | C | C |
| Continuous jetting property | | | | | | | | |
| Initial | B | B | B | A | — | A | C | C |
| After 10,000 rotations | C | C | C | C | — | C | C | C |

Comparative coated layer 5 did not form a flat surface layer, and evaluation could not be carried out.

TABLE 3

Coat layer and test result (use of dye ink CH21Y)

| (Non-volatile matter wt. %) | Coat layer 1 | 2 | 3 | 4 | 5 | 6 | 7 | 8 | 9 | 10 |
|---|---|---|---|---|---|---|---|---|---|---|
| Graft copolymer 1 solution (34.9) g | 5.0 | | | | | | | | | |
| Graft copolymer 2 solution (34.4) g | | 5.0 | | | | | | | | |
| Graft copolymer 3 solution (34.5) g | | | 5.0 | | | | | | | |
| Graft copolymer 4 solution (34.8) g | | | | 5.0 | | | | | | |
| Graft copolymer 5 solution (34.8) g | | | | | 5.0 | | | | | |
| Graft copolymer 6 solution (34.1) g | | | | | | 5.0 | | | | |
| Graft copolymer 7 solution (34.8) g | | | | | | | 5.0 | | | |
| Graft copolymer 8 solution (34.6) g | | | | | | | | 5.0 | | |
| Graft copolymer 9 solution (34.9) g | | | | | | | | | 5.0 | |
| Graft copolymer 10 solution (34.9) g | | | | | | | | | | 5.0 |
| Sumidul N3200 (Mw 478.6) g | 0.16 | 0.27 | 0.30 | | 0.55 | 0.26 | | | 0.32 | 0.78 |
| Sumidul N3300 (Mw 504.6) g | | | | 0.35 | | | 0.35 | 0.35 | | |
| Acetone g | 10.7 | 11.3 | 11.6 | 12.0 | 13.5 | 11.1 | 12.1 | 12.0 | 11.5 | 15.3 |
| Initial properties | | | | | | | | | | |
| Advancing contact angle | 75 | 75 | 74 | 72 | 68 | 70 | 69 | 69 | 71 | 67 |
| Receding contact angle | 62 | 60 | 61 | 58 | 51 | 53 | 60 | 57 | 58 | 50 |
| Ink slip property | A | A | A | A | A | A | A | A | A | A |
| After 10,000 rotations | | | | | | | | | | |
| Advancing contact angle | 64 | 62 | 61 | 60 | 61 | 58 | 57 | 61 | 60 | 46 |
| Receding contact angle | 53 | 52 | 51 | 51 | 49 | 47 | 48 | 52 | 52 | 35 |
| Ink slip property | A | A | A | A | A | A | A | A | A | B |
| Continuous jetting property | | | | | | | | | | |
| Initial | A | A | A | A | A | A | A | A | A | A |
| After 10,000 rotations | A | A | A | A | A | A | A | A | A | B |

| (Non-volatile matter wt. %) | Comparative coat layer 1 | 2 | 3 | 4 | 5 | Cytop | FEP | SR 2410 |
|---|---|---|---|---|---|---|---|---|
| Comparative Graft copolymer 1 solution (34.9) g | 5.0 | | | | | | | |
| Comparative Graft copolyrner 2 solution (34.7) g | | 5.0 | | | | | | |
| Comparative Graft copolymer 3 solution (35.0) g | | | 5.0 | | | | | |
| Comparative Graft copolymer 4 solution (35.3) g | | | | 5.0 | | | | |
| Comparative Graft copolymer 5 solution (35.3) g | | | | | 5.0 | | | |
| Sumidul N3200 (MW 478.6) g | 0.32 | | 0.33 | 0.45 | 0.36 | | | |
| Sumidul N3300 (MW 504.6) g | | 0.34 | | | | | | |
| Acetone g | 11.9 | 12.0 | 12.0 | 13.0 | 12.3 | | | |
| Initial properties | | | | | | | | |
| Advancing contact angle | 73 | 70 | 68 | 62 | — | 85 | 79 | 66 |

TABLE 3-continued

| Coat layer and test result (use of dye ink CH21Y) | | | | | | | | |
|---|---|---|---|---|---|---|---|---|
| Receding contact angle | 30 | 28 | 57 | 57 | — | 71 | 62 | 30 |
| Ink slip property | B | C | A | A | — | A | A | B |
| After 10,000 rotations | | | | | | | | |
| Advancing contact angle | 47 | 50 | 54 | 53 | — | 45 | 35 | 32 |
| Receding contact angle | 0 | 0 | 10 | 20 | — | 0 | 0 | 0 |
| Ink slip property | C | C | C | C | — | C | C | C |
| Continuous jetting property | | | | | | | | |
| Initial | B | C | A | A | — | A | A | B |
| After 10,000 rotations | C | C | C | C | — | C | C | C |

Comparative coated layer 5 did not form a flat surface layer, and evaluation could not be carried out.

Effects of the Invention

As is shown in the above examples, in the inventive ink recording head comprising the peripheral area of the ink jetting nozzle coated with a coating composition comprising the graft copolymer in the invention and a hardener and hardened to provide a hardened coat layer, the coat layer had a sufficient liquid repellent property, a sufficient anti-abrasion property, a sufficient mechanical strength, and a sufficient adhesion strength, and its liquid repellent property did not deteriorate even when the layer was in contact with the ink for a long time. Further, the coat layer could prevent, for a long term run, undesired phenomenon in that ink jetting direction deviated from a given direction or fluctuated every ink jetting, or problems in that ink scattered on ink jetting, resulting in inability of stable recording or a pool of ink covering the periphery area of the ink jetting nozzle spread, resulting in inability of ink jetting itself. That is, the inventive recording head could realize high stability, high image quality, and high durability.

What is claimed is:

1. An ink jet recording head comprising an ink jetting nozzle and a peripheral area of the ink jetting nozzle, the peripheral area having been coated with a coating composition comprising a graft copolymer having a hydroxyl group and a hardener, the equivalent amount ratio of the hydroxyl group of the graft copolymer to a reactive group of the hardener in the coating composition being 1:0.6 to 1:1.5, and then having been hardened to provide a hardened coat layer, wherein the graft copolymer is obtained by polymerizing 15 to 70% by weight of a radical polymerizable fluorine-containing resin (a) having a radical polymerizable unsaturated bond through a urethane bond, 10 to 40% by weight of a radical polymerizable polysiloxane (b) having a radical polymerizable double bond on one end thereof represented by the following formula (1) or (2), and 15 to 75% by weight of a radical polymerizable monomer (c), each being based on the total weight of the radical polymerizable fluorine-containing resin (a), the radical polymerizable polysiloxane (b) and the radical polymerizable monomer (c), formula (1)

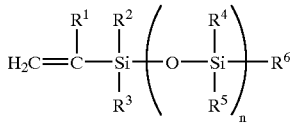

wherein $R^1$ represents a hydrogen atom or a hydrocarbon group having 1 to 10 carbon atoms; $R^2$, $R^3$, $R^4$, $R^5$, and $R^6$ may be the same as or different from another, and independently represent a hydrogen atom or a hydrocarbon group having 1 to 10 carbon atoms; and n is an integer of not less than 2, formula (2)

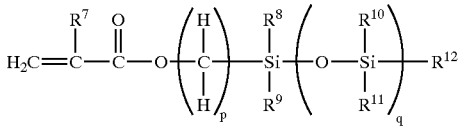

wherein $R^7$ represents a hydrogen atom or a hydrocarbon group having 1 to 10 carbon atoms; $R^8$, $R^9$, $R^{10}$, $R^{11}$, and $R^{12}$ may be the same as or different from another, and independently represent a hydrogen atom or a hydrocarbon group having 1 to 10 carbon atoms; p is an integer of 0 to 10; and q is an integer of not less than 2.

2. The ink jet recording head of claim 1, wherein the hardener is at least one selected from the group consisting of an aniline-aldehyde resin, a urea resin, a melamine resin, an isocyanate prepolymer, a blocked isocyanate prepolymer, and a diisocyanate.

3. The ink jet recording head of claim 1, wherein the graft copolymer has a hydroxyl value of 5 to 120.

4. The ink jet recording head of claim 1, wherein the graft copolymer has a hydroxyl value of 20 to 80.

5. The ink jet recording head of claim 1, wherein the hardened coat layer has a thickness of 0.1 to 5 $\mu$m.

6. An ink jet recording apparatus equipped with the ink jet recording head of claim 1.

7. The ink jet recording head of claim 1, wherein the equivalent amount ratio of the hydroxy group of the graft copolymer to the reactive group of the hardener in the coating composition is 1:0.7 to 1:1.3.

* * * * *